United States Patent [19]

Bockelmann et al.

[11] 4,000,615

[45] Jan. 4, 1977

[54] CONTROL INSTALLATION FOR THE PROPORTIONING OF A SECONDARY AIR QUANTITY FOR IMPROVEMENT OF THE COMBUSTION IN INTERNAL COMBUSTION ENGINES OR THE AFTERBURNING OF THE EXHAUST GASES OF INTERNAL COMBUSTION ENGINES

[75] Inventors: Wilfried Bockelmann, Buttgen; Hans Grözinger, Neuss; Peter Ulrich Wöbky, Nievenheim, all of Germany

[73] Assignee: Deutsche Vergase Gesellschaft MBG & Co KG, Neuss, Germany

[22] Filed: Jan. 22, 1975

[21] Appl. No.: 543,052

[30] Foreign Application Priority Data

Jan. 23, 1974 Germany ..... 2401313

[52] U.S. Cl. ..... 60/277; 60/290

[51] Int. Cl.[2] ..... F01N 3/10; F02B 75/10

[58] Field of Search ..... 60/277, 289, 290

[56] References Cited

UNITED STATES PATENTS

| | | | |
|---|---|---|---|
| 3,360,927 | 1/1968 | Cornelius | 60/277 |
| 3,738,108 | 6/1973 | Goto | 60/277 |
| 3,812,673 | 5/1974 | Muroki | 60/289 |
| 3,945,205 | 3/1976 | Atago | 60/290 |

*Primary Examiner*—Douglas Hart

[57] ABSTRACT

A control installation for the dosing or proportioning of a secondary air quantity for the improvement of combustion in internal combustion engines, or the afterburning of the exhaust gases of internal combustion engines, including an auxiliary arrangement which is responsive to an emergency signal for effecting the prompt shutting-off of the secondary air. The emergency signal may be initiated in response to a failure in the ignition voltage of the internal combustion engine; an increase in the hydrocarbon content of the exhaust gases; a disparity between the position of the mixture dosing element and the engine rotational speed; the exceeding of a limiting temperature in the exhaust gas manifold; or the exceeding of a limiting temperature in the afterburner.

3 Claims, 3 Drawing Figures

CONTROL INSTALLATION FOR THE PROPORTIONING OF A SECONDARY AIR QUANTITY FOR IMPROVEMENT OF THE COMBUSTION IN INTERNAL COMBUSTION ENGINES OR THE AFTERBURNING OF THE EXHAUST GASES OF INTERNAL COMBUSTION ENGINES

FIELD OF THE INVENTION

The present invention relates to a control installation for the dosing or proportioning of a secondary air quantity for the improvement of combustion in internal combustion engines or the afterburning of the exhaust gases of internal combustion engines.

It has been found as essential that suitable measures be taken for converting the deleterious materials which are contained in the exhaust gas of internal combustion engines, such as carbon monoxide (CO), hydrocarbons ($C_xH_y$) and nitric oxides ($NO_x$), into harmless chemical compounds. For this purpose, there are utilized thermally and catalytically operating reactors or afterburners.

When an internal combustion engine is driven at variable loads, there continually varies the composition of the exhaust gases. As a result, the after burning is disturbed since, at any one time, an excess and at another time sufficient oxygen is available for the afterburning sequence.

DISCUSSION OF THE PRIOR ART

In order to avoid this disadvantage, it is currently known that the internal combustion engine may be operated with a deficiency or lack of air ($\lambda<1$), and to introduce the combustion air which is required for afterburning by means of a motor-driven air pump. An installation of that type is illustrated and described in German Laid-Open Pat. Spec. No. 2,035,591.

In accordance with the disclosures in German Laid-Open Pat. Nos. 2,012,118 and 2,120,950, the dosing or proportioning of the secondary air is effected through switching arrangements to which there may be transmitted a number of measuring parameters. Pursuant to German Laid-Open Pat. No. 2,064,266, there has become known a switching arrangement for exhaust gas reconveyance which may similarly be influenced by a plurality of measuring parameters.

However, in the known installations, the switch conditions vary discontinuously and, consequently, do not afford a constant regulation.

A further disadvantage of the known installations consists of in that the quantity of secondary air cannot be controlled in a precise and sufficiently rapid manner. The afterburner, accordingly, cannot operate to an optimum degree, and the deleterious materials are not sufficiently effectively converted.

In accordance with the disclosure in German Pat. No. 2,254,961 U.S. Pat. No. 3,931,710, there has already been proposed that the control installation has a plurality of measuring parameters transmitted thereto from externally thereof, while the quantity of the air flowing into the regulating installation is concurrently proportioned in dependence upon the rotational speed of the engine, serving as a measuring parameter, by means of an air pump which is driven by the engine, and wherein the control installation incorporates an arrangement for the measuring parameter-dependent withdrawal and reconveyance of a portion of the air flowing into the control installation.

During the operation of that type of control installation, interruptions may always occur when excessive uncombusted hydrocarbons are conducted into the afterburner through the exhaust gas manifold, and are burnt therein in unacceptably large amounts. In particular, in catalytically operating afterburners, destruction of the afterburner may occur within an extremely short period.

SUMMARY OF THE INVENTION

Accordingly, it is an object of the present invention to provide a control installation which eliminates the disadvantage encountered in the prior art and which, during disruptive operation, prevents possible destruction of the afterburner.

Pursuant to the invention, this object is inventively attained in that there is provided an auxiliary arrangement which is responsive to an emergency signal for effecting the prompt shutting-off of the secondary air.

The emergency signal may be initiated in response to a failure in the ignition voltage of the internal combustion engine; an increase in the hydrocarbon content of the exhaust gases, a disparity between the position of the mixture dosing element and the engine rotational speed; the exceeding of a limiting temperature in the exhaust gas manifold; or the exceeding of a limiting temperature in the afterburner.

Suitably, these emergency signals are conveyed to the auxiliary arrangement in the form of electrical signals.

In a variation of the invention, the auxiliary arrangement consists of a switching or reversing valve which is so located in the flow path of the conduits conveying the secondary air whereby, during undisturbed operation is released an air flow, and during disrupted operation, upon receipt of the emergency signal, the air flow is promptly switched over into either the atmosphere or back to the air pump.

Hereby, the reversing valve may be directly actuated either electromagnetically or pneumatically, wherein there is located in the flow path of the pneumatically actuated conduit, a smaller electromagnetically actuated valve which is responsive to an emergency signal.

The electromagnetically actuated valve, during disrupted operation, upon receipt of the emergency signal connects the actuating conduit of the pneumatically actuated reversing valve with a supply source having a lower pressure than atmospheric pressure.

In a preferred embodiment of the invention, the control installation itself assumes the function of pneumatically operated reversing valve for effectuating the emergency shut-off of the secondary air, within which there is located a small electromagnetically actuated reversing valve which during undisturbed operation, connects a control pressure chamber of the control installation with a conduit leading to the exhaust gas manifold, and during disrupted operation, upon receipt of the emergency signal, connects with a conduit leading to the inlet or suction side of the internal combustion engine or to a source of low pressure, whereby the control installation completely shuts-off the conveyance of secondary air to the exhaust gas manifold, and the entire air supplied by the air pump is reconveyed in a closed circuit to the air pump.

BRIEF DESCRIPTION OF THE DRAWINGS

Reference may now be had to the following detailed description of an exemplary embodiment of the invention, taken in conjunction with the accompany drawings; in which.

DETAILED DESCRIPTION

Figure 1:
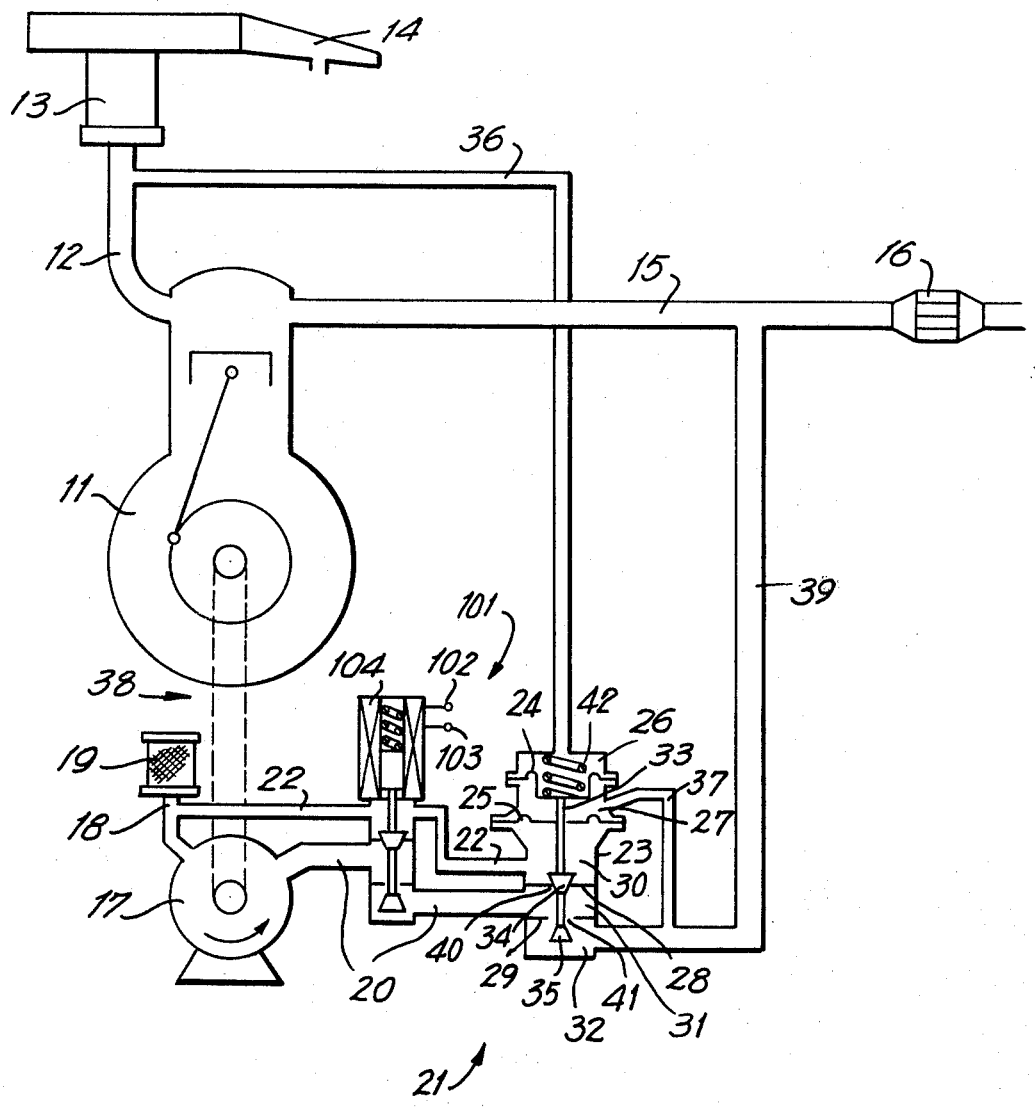
FIG. 1 schematically illustrates a control installation constructed according to a first embodiment of the invention.

In accordance with the embodiment shown in FIG. 1, the internal combustion engine 11 includes the vacuum conduit or inlet manifold 12, on the inlet side thereof to the end of which there is mounted a carburetor 13. The air inlet is carried out through the air filter 14. The fuel infeed and fuel-air mixture forming arrangements of the carburetor are not illustrated in the drawings.

At its exhaust side, the internal combustion engine 11 includes an exhaust gas manifold 15 which leads to the after-burner 16. An air pump 17 is connected with a filter 19 through the intermediary of a suction conduit 18, across which there is aspirated secondary air from atmosphere. A conduit 20 leads from the air pump 17 to the control installation 21. An air return conduit 22 leads from the control installation 21 back to the suction conduit 18.

The control installation 21 includes a multi-part housing 23, the latter of which is divided by the membranes 24 and 25 into control pressure chambers 26 and 27, and through partitions 28 and 29 into pressure chambers 30, 31 and 32. The conduit 20 connects into the pressure chamber 31, and the air return conduit 22 connects into the pressure chamber 30.

The membrane 25 has a larger active or operative surface than the membrane 24. Both membranes are rigidly connected with a guide rod 33 on which measuring or dosing conical valves 34 and 35 are mounted in superimposed relationship. The dosing conical valves operate in conjunction with dosing apertures 40 and 41 provided in, respectively, the partitions 28 and 29.

Utilized as non-linearly mutually interdependent measuring parameters are the vacuum manifold pressure, the exhaust gas back-pressure and the engine rotational speed. The vacuum manifold pressure is transmitted to the control installation 21 through the conduit 36, and the exhaust gas back-pressure through the conduit 37.

The engine rotational speed is transmitted by means of the drive 38 directly to the air pump 17, similarly, and indirectly to the control installation 21 through the rotationally-dependent conveyed quantity by means of conduit 20. Through the conduit 39, the secondary air is blown into the exhaust gas manifold 15.

In the stationary engine condition, both dosing conical valves are brought into their lowest position in response to the action of the pressure spring 42 on the membrane 24, so that the valve dosing opening 40 is closed and the valve opening 41 is completely opened.

During operation, the air pump 17 supplies a more or less large air quantity in accordance with engine rotational speed. At a high vacuum manifold pressure, the pressure spring 42 is unloaded so that the dosing conical valves are downwardly displaced. Hereby, the return flow of the secondary air from the pressure chamber 31 into the pressure chamber 30, and from there into the air return conduit 22, is either reduced or completely blocked, while the dosing opening 41 is opened more or less for permitting the through-passage of the secondary air from the pressure chamber 31 into the pressure chamber 32, and from there through the conduit 39 into the exhaust gas manifold 15. The lower the vacuum manifold pressure, the higher are the dosing conical valves 34 and 35 raised, and that much more air is reconveyed, while the output of secondary air is reduced.

The exhaust gas back pressure which is present in conduit 39 is reconveyed through the conduit 37 to the control pressure chamber 27 as a measuring parameter.

Due to the size difference between membranes 24 and 25, an increasing exhaust gas back-pressure causes an increasing opening, and a reducing exhaust gas back-pressure a further closing of the dosing valve opening 41.

Located in the flow path of conduit 20 and the air return conduit 22 is the electromagnetically actuated switching or reversing valve 101. The latter is, as illustrated, currentless during undisturbed operation, so that the flow connection is open in conduit 20, whereas the flow connection of conduit 20 with the air return conduit 22 is, in contrast therewith, shut off.

As soon as an electrical emergency signal is transmitted to the exciter winding 104 of the reversing valve 101 through the electrical contact points 102 and 103, the valve promptly reverses and interrupts the unhindered passage through conduit 20, while the air supplied by the air pump 17 is reconveyed into the air return conduit.

Figure 2:
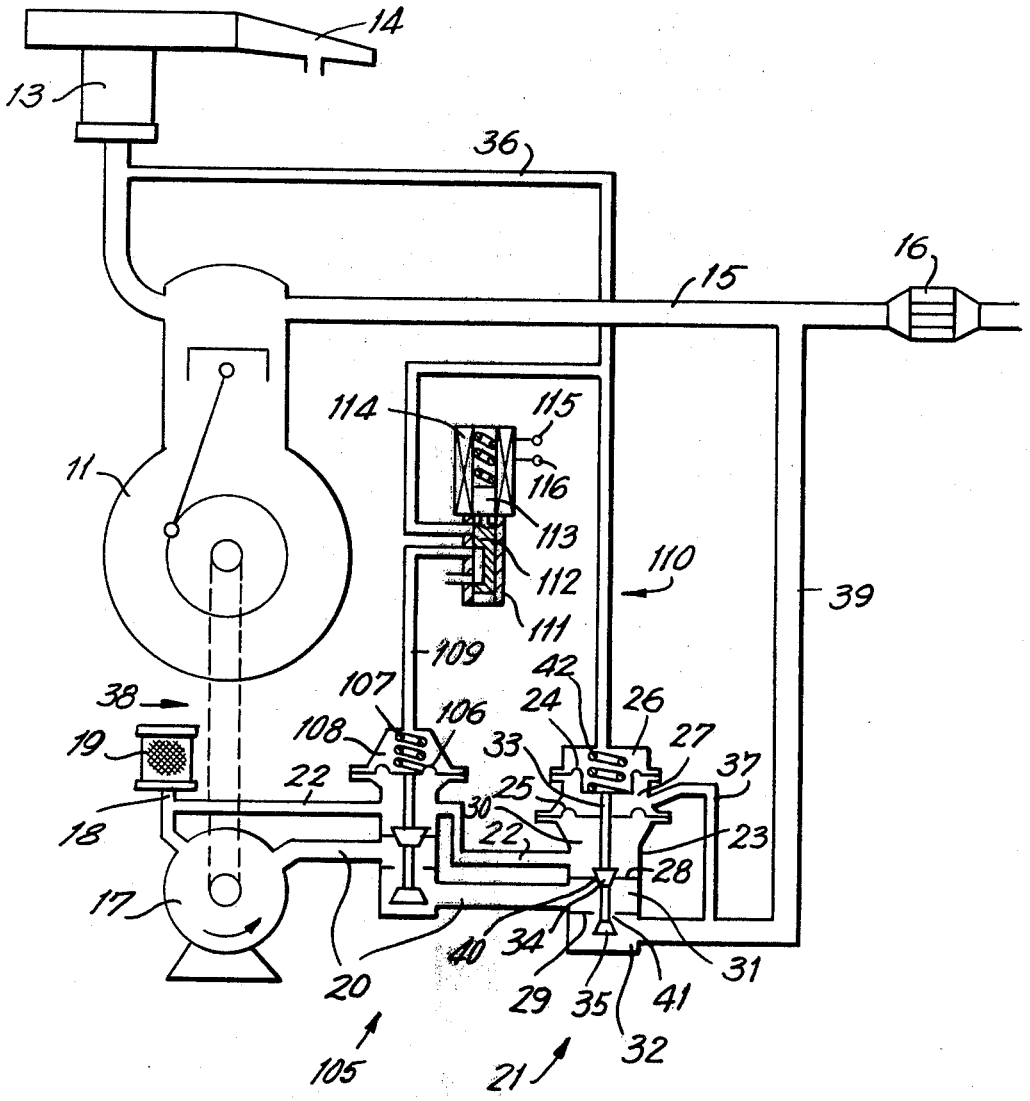
FIG. 2 illustrates a second embodiment of the control installation.

In accordance with the modified embodiment of FIG. 2, in lieu of an electromagnetically actuated reversing valve there is utilized a pneumatically actuated reversing valve 105 in the flow path of conduit 20 and air return conduit 22. The valve possesses a control membrane 106 which is loaded by a membrane spring 107, and a control pressure chamber 108.

From the control pressure chamber 108 of the reversing valve 105, an actuating conduit 109, leads to an electromagnetically actuated valve 110. The valve 110 consists of a control piston 111, a control slider 112 to which there is fastened a magnetic armature 113, and the magnetic coil 114 with the electrical contact points 115 and 116.

During undisturbed operation, the magnetic coil 114, as illustrated, is currentless, so that the control slider 112 is located in its lower position and thereby connects the actuating conduit 109 with atmosphere. Within the control pressure chamber 108 there also reigns atmospheric pressure, and, as illustrated, the membrane spring 107 has moved the control membrane 106, together with all of the components fastened to the membrane, into the lower position. The connection from the conduit 20 to the air return conduit 22 is thereby closed off, while in contrast therewith, the conduit 20 provides a free flow through passage.

As soon as occasioned in response to an emergency signal, an electrical voltage is applied to the contact points 115 and 116 of the magnetic coil 114, the magnetic coil 114 pulls up the magnetic armature 113, and thereby also the control slider 112, so that the actuating conduit 109 is placed into communication with the conduit 36 leading to the suction side of the internal combustion engine.

In that instance, there is a vacuum present in the control pressure chamber 108 so that the reversing valve 105 switches promptly, and thereby completely closes off the conduit 20.

Figure 3:
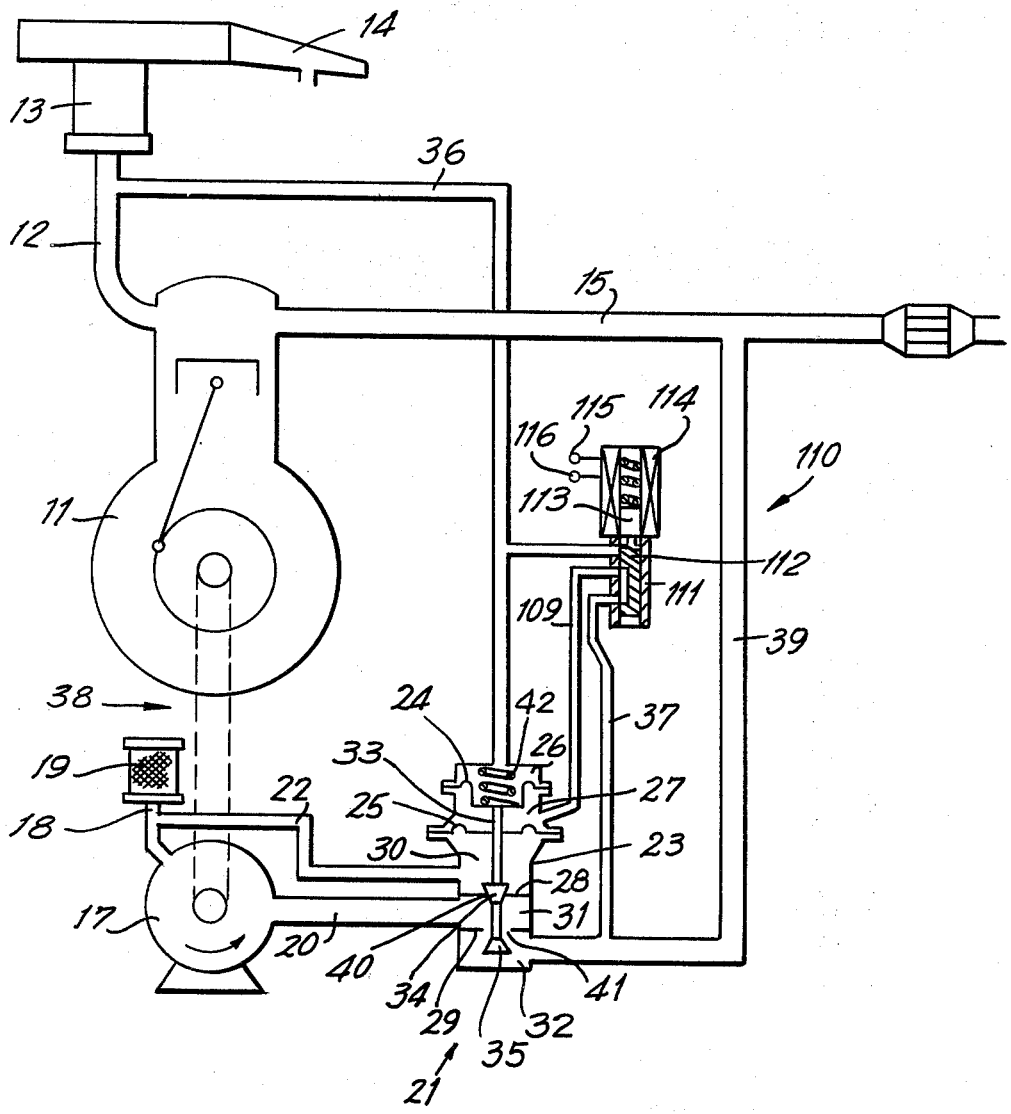
FIG. 3 illustrates a third embodiment of the inventive control installation.

In the embodiment of the invention according to FIG. 3, fewer individual components are needed since the control installation 21 itself concurrently assumes the function of a pneumatically actuated reversing valve for effectuating the emergency shutting-off of the secondary air.

The reversing valve 110 which is electromagnetically actuated as shown in FIG. 3 is in more detail described with respect to the embodiment of FIG. 2. It is represented in the currentless condition, conforming to undisturbed engine operation.

The conduit 37, which leads to the exhaust gas manifold 15 through intermediary of the conduit 39, is connected through the reversing valve 110 with the actuating conduit 109, the latter of which leads to the control pressure chamber 27 of the control installation 21. Hereby, the control installation 21 is enabled to fulfill its normal regulating function.

As soon as an emergency signal reaches the reversing valve 110, this valve switches the actuating conduit 109 into communication with the conduit 36 leading to the suction side of the internal combustion engine, through which the inlet sided vacuum pressure comes in effect also in the control pressure chamber 27, and the dosing conical valves 35 and 40 are immediately brought into their uppermost position. Herewith the normal regulating function of the control installation 21 is interrupted, the conduit 20 is fully blocked off from conduit 39 and, in contrast therewith, the conduit 20 connected with the air return conduit 22.

In the embodiments of the invention illustrated in FIGS. 2 and 3 of the drawings, the actuating conduits 106, upon occurrence of an emergency signal may be suitably connected, instead of to conduit 36, to a source of low pressure which is independent of the operating condition of the internal combustion engine, for example, to a vacuum storage which is charged during the operation of the internal combustion engine. In this case, there is continually supplied a sufficiently high pressure differential.

The advantage of the invention preferably lies in that, even during operating disruptions of the internal combustion engine, the exhaust gas purifying installations are not affected, and continuous damage to these installations that might have remained unrecognized and consequent failure of exhaust gas purification is avoided.

While there has been shown what is considered to be the preferred embodiment of the invention, it will be obvious that modifications may be made which come within the scope of the disclosure of the specification.

What is claimed is:

1. In a control installation for the proportioning of a quantity of secondary air for improving the combustion in an internal combustion engine or the afterburning of the exhaust gases of the internal combustion engine, including a plurality of external measuring parameters being transmitted to said control installation; an air pump driven by said engine adapted to dose the air quantity flowing into said control installation dependent upon the rotational speed of said engine forming a measuring parameter; and an arrangement operatively connected with said control installation for withdrawing and reconveying a portion of the air flowing into said control installation dependent upon at least one of the measuring parameters, the improvement comprising: an auxiliary arrangement associated with said control arrangement for the instantaneous shutting-off of the flow of said secondary air responsive to a generated emergency signal; conduit means for conveying said secondary air flow, said auxiliary arrangement comprising a reversing valve located in the flow path of said conduit means adapted to permit free air flow therethrough during undisturbed operation and, upon receipt of a generated emergency signal, to instantaneously divert the flow of air to atmosphere or back to said air pump; said reversing valve being pneumatically actuated through an actuating conduit thereof; and a smaller-proportioned electromagnetically-actuated valve being located in the flow path of said actuating conduit and being responsive to said emergency signal; said pneumatically actuated reversing valve being an integral element of said control installation, said installation including a control pressure chamber, said electromagnetically-actuated valve connecting said control pressure chamber with the exhaust gas manifold of said engine through a conduit during the undisturbed operation of said engine and, in response to an emergency signal during disrupted operation, with a conduit connected to the suction side of the engine.

2. A control installation as claimed in claim 1, said emergency signal comprising an electrical signal adapted to be transmitted to said auxiliary arrangement.

3. A control installation as claimed in claim 1, said electromagnetically-actuated valve, responsive to an emergency signal during disrupted operation, connecting said actuating conduit of said pneumatically actuated reversing valve to a source of pressure lower than atmospheric pressure.

* * * * *